United States Patent [19]

Downer

[11] 4,019,212

[45] Apr. 26, 1977

[54] BOAT COVER APPARATUS

[76] Inventor: Jason K. Downer, Box No. 522, Alexandria, Minn. 56308

[22] Filed: Dec. 29, 1975

[21] Appl. No.: 644,466

[52] U.S. Cl. ..... 9/1.5; 61/65; 135/6

[51] Int. Cl.[2] ..... B63B 17/02

[58] Field of Search ..... 114/45, 48, .5 BD, 71; 61/64–67; 9/1.1, 1.5; 135/6, 8

[56] References Cited

UNITED STATES PATENTS

| | | | |
|---|---|---|---|
| 1,780,322 | 11/1930 | Tsuji | 135/8 |
| 2,708,346 | 5/1955 | Smith | 114/.5 BD |
| 2,930,387 | 3/1960 | Streich et al. | 135/6 |
| 3,077,742 | 2/1963 | Brown | 61/65 |
| 3,169,644 | 2/1965 | Gudbersen | 61/65 |

*Primary Examiner*—Trygve M. Blix
*Assistant Examiner*—Stuart M. Goldstein
*Attorney, Agent, or Firm*—Dugger, Johnson & Westman

[57] ABSTRACT

A boat cover apparatus that includes a boat lift assembly mounted on a main frame for lifting a boat above the level of the water, a cover assembly that includes a cover frame having a subframe of a size and shape that is greater than the maximum horizontal dimensions of the boat to be covered, frame members secured to and extending above the subframe, a collapsible cover having outer peripheral edges removably secured to the subframe and springs that are secured to the frame members and to portions of the cover substantial distances inwardly of the peripheral edges thereof to support the portions to which they are secured at a higher elevation than the subframe whereby when the subframe is moved to a lower elevation than the boat, the cover will extend upwardly and inwardly of the subframe to abut against the upper peripheral edge portion of the boat, and a cable assembly mounted on the main frame and secured to the cover assembly for selectively elevating the cover assembly to an elevation substantially above that of the boat and alternately lowering the cover assembly to an elevation that the subframe is at a lower elevation than the upper peripheral edge portion of the boat.

9 Claims, 5 Drawing Figures

BOAT COVER APPARATUS

BACKGROUND OF THE INVENTION

A cover assembly for enclosing the top open portions of the boat.

In the prior art is is old to provide a boat dock that includes an open framework mounting a roof and which may be provided with side walls, and also to mount vertically elevatable craddle devices on the framework of lifting the boat out of the water at a location beneath the roof, for example, see U.S. Pat. No. 3,077,742. Additionally, it is old to provide a cable assembly that is attached to the four upper corners of an open bottom, rectangular, box shaped hood that is provided for covering an automobile, the lower edges of the hood being attached to a metal frame, and a second cable assembly being connected to the frame for elevating the frame and thereby the lower portions of the hood (see U.S. Pat. No. 1,801,247). Also, it is old to provide a canvas cover for a boat wherein the cover has a draw rope at the peripheral edge thereof for retaining the lower edge portions of the canvas in abutting relationship to the sides of the boat (see U.S. Pat. No. 2,536,152). However, with such prior art cover apparatus it still remains a problem of providing a suitable cover for a boat that has been elevated out of the water by a lift assembly and while the boat is still on the lift assembly, may be easily moved relative to the boat to a position to form a closure extending across the open top of the boat and abutting against the boat to block the movement of dirt, insects, etc. into the interior of the boat, and also that may be easily elevated to a position sufficiently above the boat that a person on the dock adjacent the boat may climb into the boat. In order to overcome problems such as the above, as well as others, this invention has been made.

SUMMARY OF THE INVENTION

For covering a boat that is on a lift assembly supporting the boat above the level of the water, cover apparatus that includes a cover assembly having collapsible cover mounted by a cover frame to abut against the upper, outer peripheral edge portion of a boat as the cover assembly is moved between an elevated position and a lowered position that the cover frame extends to the lower elevation than said peripheral edge portion, and a cable assembly for selectively elevating the entire cover assembly above the boat and alternately lowering the cover assembly.

One of the objects of this invention is to provide a new and novel cover assembly that is vertically movable relative a lift assembly that is used for elevating a boat above the level of the water. Another object of this invention is to provide new and novel means for mounting a cover whereby upon lowering the cover, the cover will abut against the upper, outer peripheral edge portion of the boat to close the top opening of the boat. An additional object of this invention is to provide new and novel boat cover apparatus that includes a vertically translatable cover frame and a collapsible cover mounted on the frame for movement therewith, and cable apparatus for translating the cover frame between an elevated position above the boat on a boat lift and a lowered position that the cover is still a substantial distance above the level of water and forms a fit with the boat to block the movement of dirt, insects, etc. into the interior of the boat.

Figure 2:
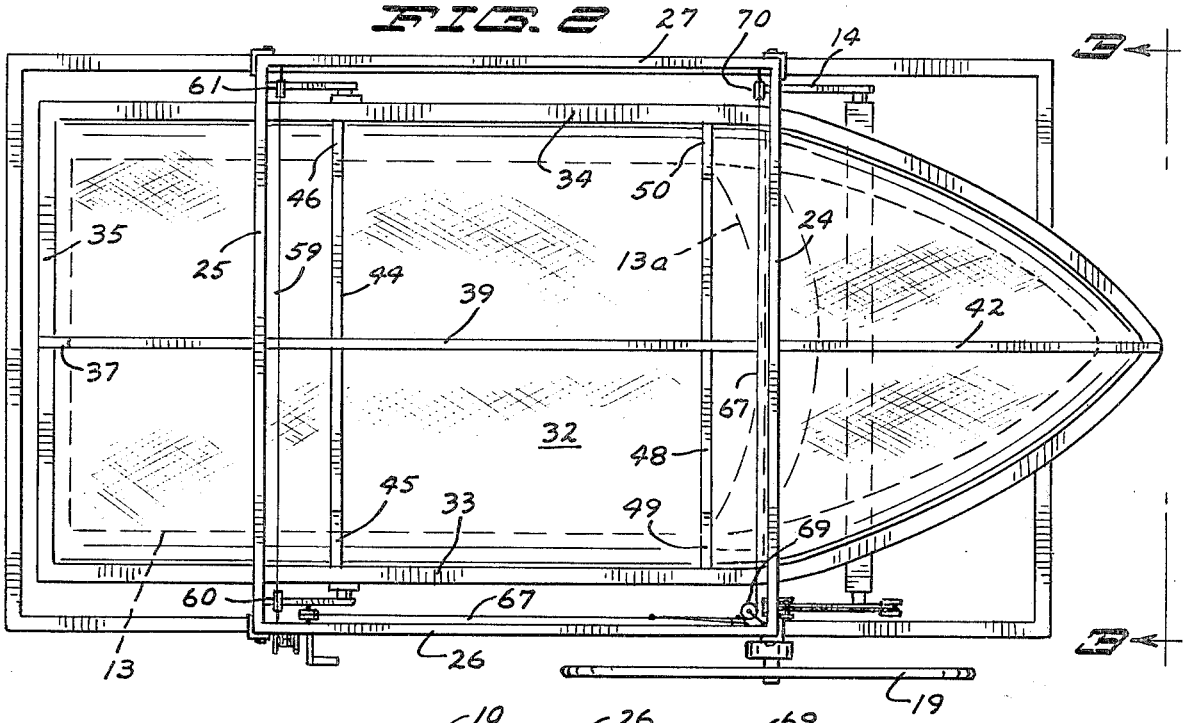
FIG. 2 is a top view of the apparatus of FIG. 1.
Figure 1:
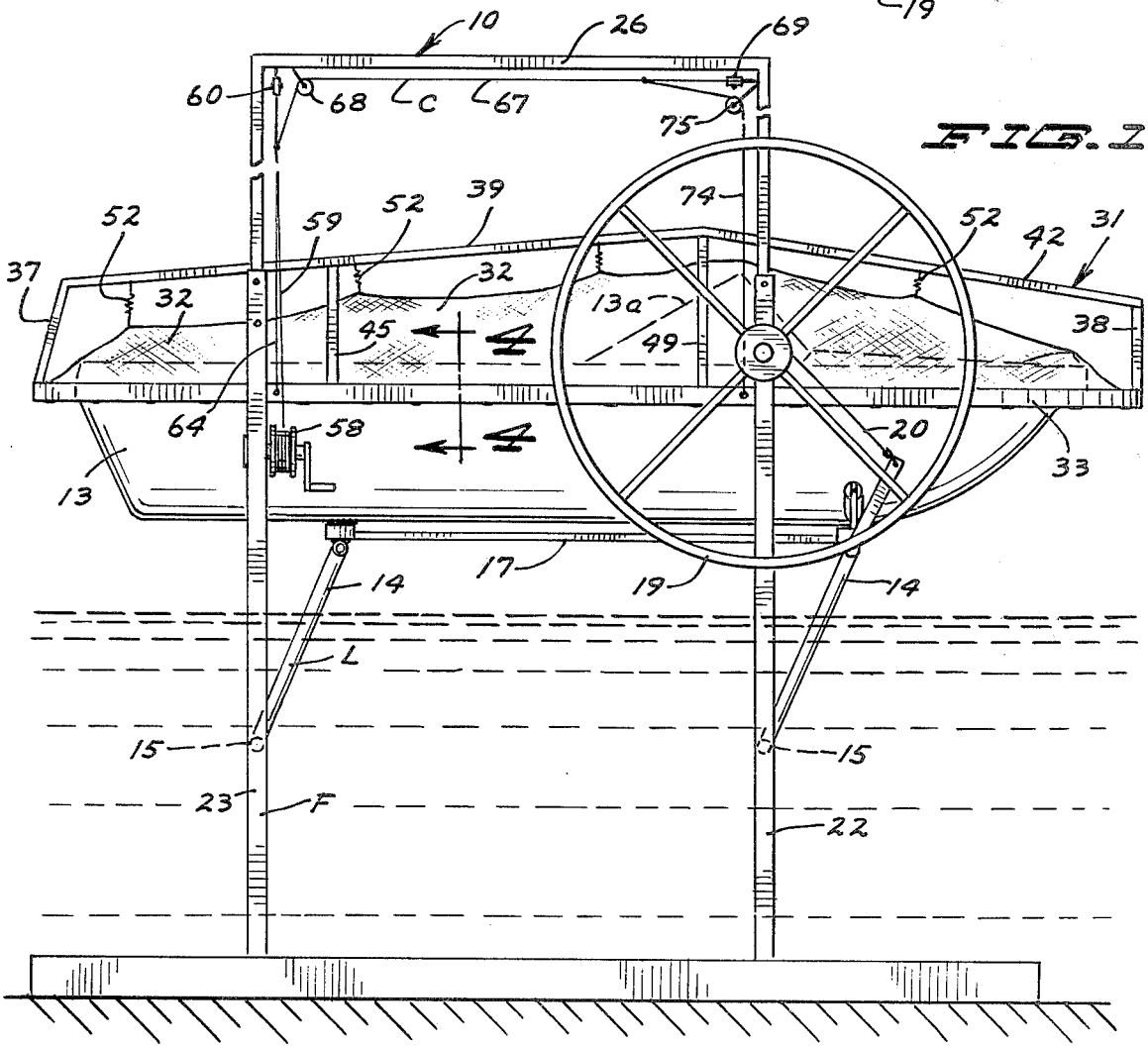
FIG. 1 is a side view of the cover apparatus of this invention in its lowered position relative to a boat in an elevated position, a vertically intermediate portion of the main frame being broken away.
Figure 3:
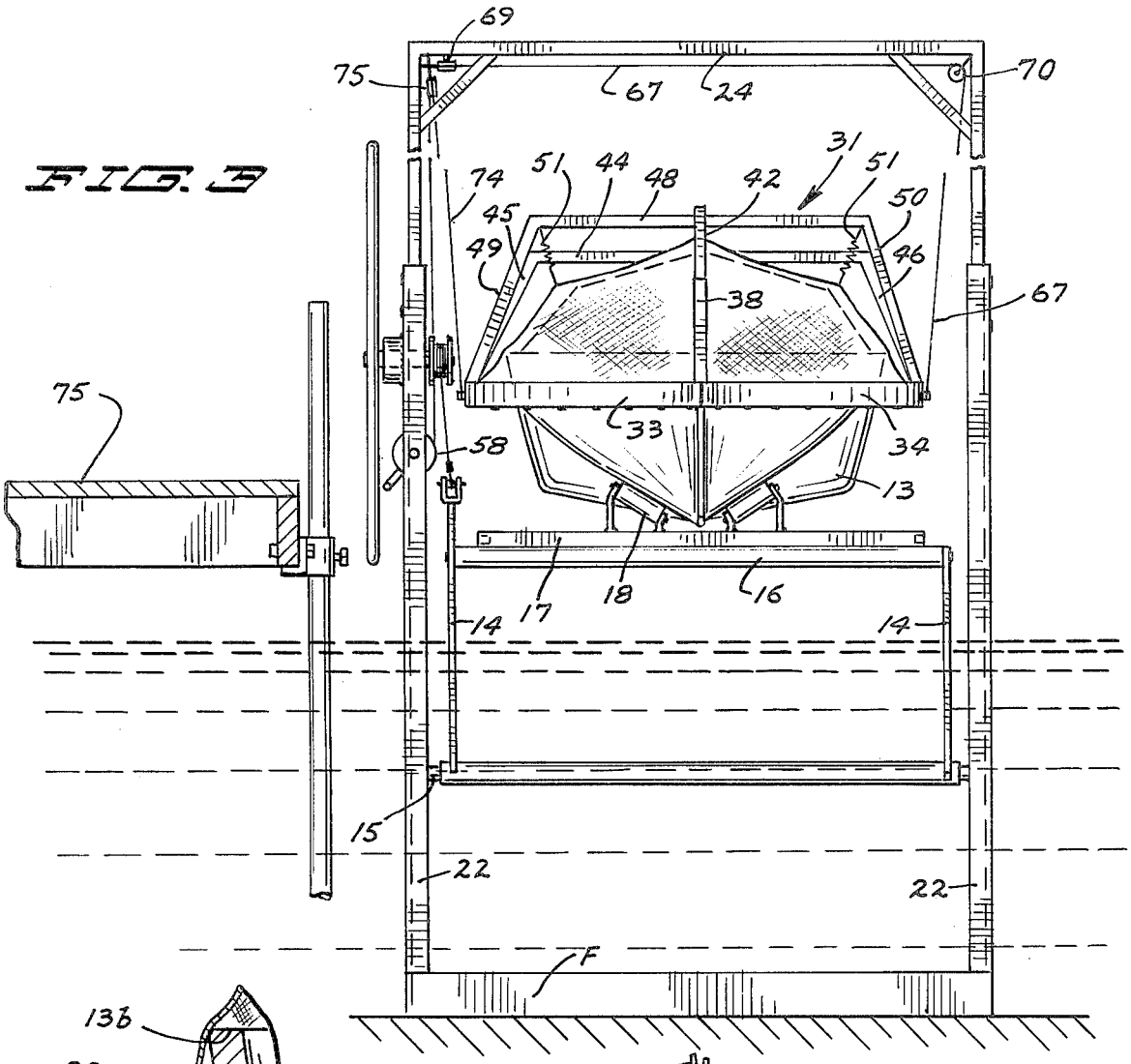
FIG. 3 is a front view of the apparatus of FIG. 1, said view being generally taken along the line and in the direction of the arrows 3—3 of FIG. 2.
Figure 4:
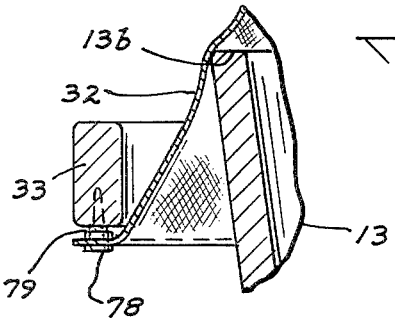
FIG. 4 is a fragmentary view generally taken along the line and in the direction of the arrows 4—4 of FIG. 1 to illustrate the cover abutting against an upper peripheral outer edge portion of the boat.
Figure 5:
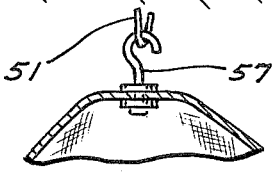
FIG. 5 is a fragmentary view illustrating hook structure attached to the cover for dependingly attaching the adjacent part of the cover to a spring.

Referring now in particular to FIGS. 1–3, the apparatus of this invention, generally designated 10, includes a main frame F on which there is mounted a conventional boat lift L for elevating the boat 13 above the level of the water. The boat lift L has a pair of transversely spaced front legs 14 and a pair of transversely spaced rear legs, the one ends of the legs being mounted on members 15 for pivotal movement relative thereto. The opposite ends of the legs pivotally mount front and rear cross members 16 which in turn mounted an open, generally rectangular lift frame 17. The lift frame mounts front and rear boat support members 18 for supportingly engaging the bottom part of the boat. A motor or a hand operated wheel 19 is mounted on the main frame for winding and unwinding a cable 20 that is connected to one of the legs for selectively moving the lift frame between an elevation above the surface of the water and an elevation sufficiently below the surface of the water that the boat may be floated to a position above support members 18. Since the boat lift mechanism L is of the conventional construction, and may be of construction similar to that illustrated in U.S. Pat. No. 3,169,644, it will not be further described.

For mounting the cover assembly of this invention, generally designated 31, the frame F includes a pair of front uprights 22, a pair of rear uprights 23, a top longitudinal frame member 26 connecting the upper ends of the uprights 22 and 23 on one side and a top longitudinal frame member 27 connecting the upper ends of uprights 22 and 23 on the other side. A top transverse frame member 24 is mounted by the upper ends of the uprights 22 while a top transverse frame member 25 is mounted by the upper ends of the uprights 23. As may be noted from the drawings, the top frame members 24–27 are joined at adjacent ends and are located at a substantially higher elevation than the boat lift L in its elevated position.

The cover assembly 31 includes a cover 32 made of a collapsible material such as canvas or suitable plastic, there being provided a cover mounting frame that includes generally horizontal side frame members 33, 34 which have the forward end portions curved to meet at a point and rearward end portions retained in transverse spaced relationship by a cover assembly rear frame member 35. The frame members 33–35 are of a size and shape to provide an opening that is substantially larger than the maximum outer, upper peripheral dimensions of the boat in plan view whereby said frame members may be freely moved in a vertical direction between an elevated position substantially above the boat; and a substantially lower elevation than part of the boat that is of a maximum cross-sectional area in a nearly horizontal plane to be in surrounding and spaced relationship thereto, at a higher elevation than the water. Advantageously, the frame members 33–35 are substantially coplanar relative to one another.

A rear diagonal frame member 37 has its lower end secured to the transverse central portion of frame member 35 and extends forwardly thereof and predominantly upwardly relative thereto. The upper end of the frame member 37 is attached to the rear end of a longitudinal frame member 39 which extends predominantly forwardly and slightly upwardly. The forward end of frame member 39 is joined to the rear end of the front longitudinal frame member 42 which extends downwardly and predominantly forwardly, the front end of the frame member 42 being joined to the upper end of an upright 38. The upright 38 has its lower end joined to one or both of frame members 33, 34 adjacent the juncture thereof. Thus, frame members 39, 42 are at substantially higher elevation than frame members 33–35 and substantially transversely centered relative thereto.

A top, rear transverse frame member 44 has its midportion joined to frame member 39 at a location more closely adjacent the rearward end of frame member 39 than its forward end and a substantial distance forwardly of frame member 35. One end of frame member 44 is joined to the upper end of a diagonal brace 45 that extends downwardly and transversely outwardly, the lower end of said brace being joined to frame member 33. The opposite end of frame member 44 is joined to the upper end of a diagonal brace 46 that extends downwardly and transversely outwardly, the lower end of brace 46 being joined to frame member 34.

A transverse frame member 48 has its midportion secured to the front end of frame member 39, one end of frame member 48 being connected to the upper end of a brace 49 which extends downwardly and transversely outwardly to have its lower end secured to frame member 33. The opposite end of frame member 48 is connected to the upper end of a brace 50 which is inclined downwardly and transversely outwardly to have its lower end connected to frame member 34. As may be noted from FIG. 3, braces 45, 46 49 and 50 are inclined to extend transversely inwardly and predominantly vertically while their junctures with the respective frame members 44, 48 are located to be above and advantageously transversely inwardly of the outer periphery of the boat when the cover assembly is in its lowered position.

Preferably, the frame member 48 is located longitudinally to extend above or be longitudinally adjacent the upper edge portion of the windshield 13*a* of the boat, provided the boat has such a windshield. A coil spring 51 has its upper end joined to frame member 48 adjacent its juncture with brace 49 while its opposite end is removably mounted on a hook member 57 which is in turn secured to the cover. A second spring 51 has its upper end removably secured to the opposite end of frame member 48 while the opposite end of the spring is secured to a hook member 57. As may be noted in FIG. 3, when the cover assembly covers a boat, the above mentioned springs 51 are inclined downwardly and transversely inwardly whereby the transverse spacing of their hook members is substantially less than the maximum transverse spacing of the upper transverse outer peripheral edge portions 13*b* of the boat that are therebeneath but greater than one half of the maximum transverse spacing thereof.

A coil spring 52 has its upper end connected to the midportion of frame member 42 and an opposite end connected to a hook member 57 that is approximately directly vertically beneath its upper end and located longitudinally intermediate the front end of the boat and the windshield in the cover assembly boat covering position. Similarly, a plurality of coil springs 52 have their upper ends connected to frame member 39 in longitudinal spaced relationship and their opposite ends connected to hook members 57, the forwardmost and rearwardmost springs 52 being located forwardly and rearwardly of the front and rear end portions respectively of the boat when the cover assembly is in its boat covering position. It is to be understood that in place of coil springs, rubber bands could be used. The coil springs are of approximately the same lengths, and are of lengths whereby when the boat cover assembly is in an elevated position, the springs retain parts of the cover to which they are connected at substantially higher elevations than frame members 33–35. As a result, when the cover assembly is in an elevated condition, the cover does not drape down sufficiently to interfere with the movement of the boat onto the lift assembly and the movement of the boat to an elevated position by the lift assembly. Also, the springs retain the cover at elevations that do not interfere with a user entering into and exiting from a boat in the boat and cover assembly elevated positions.

In order to translate the cover assembly between a lowered position in which the frame members 33–35 are at a lower elevation than the top side and rear edges of the boat in the boat elevated position on the boat lift assembly, and an elevation that the subframe 33–35 is sufficiently above the boat that the user of the boat may move from the boat dock 75 and into the boat, there is provided a cable lift assembly C that includes a winch 58 secured to one of the main frame uprights, for example upright 23 that is adjacent to the dock 75. One end of the cable 59 is secured to the winch with a run of the cable extending from the winch up to a pulley 60 that is mounted adjacent the juncture of upright 23 and frame member 26; cable 59 having a run that extends transversely from pulley 60 to a pulley 61 that is adjacent the junctures of upright 23 and frame 27, and then along a run that extends downwardly to be connected to the vertically adjacent part of frame member 34. A cable 64 has one end connected to frame member 33 transversely opposite the connection of cable 59 to frame member 34, cable 64 having a run extending upwardly from frame member 33 to pulley 60 and then over said pulley to be connected to the run of cable 59 that is between pulley 60 and the winch when the cover assembly is in its lowered position. A cable 67 has one end secured to the run of cable 59 that extends between the winch and pulley 60 when the cover assembly is in its lowered position, cable 67 having a run extending upwardly to a pulley 68 that is mounted adjacent the juncture of upright 23 and frame member 26, then having a run extending forwardly to a pulley 69 that is located adjacent the junctures of frame members 24, 26, thence extending transversely along a run to pulley 70 which is mounted adjacent the juncture of frame member 24, 27 and then extending downwardly along a run to have the opposite end of the cable secured to frame member 34. Transversely opposite of the part of frame member 34 that one end of the cable 67 is secured to, one end of a cable 74 is secured to cover frame member 33, cable 74 extending upwardly to a pulley 75 that is mounted adjacent the junctures of frame members 24, 26, the opposite end of cable 74 being secured to the run of cable 67 that is between pulleys 68, 69 when the cover assembly is in its lowered position. By providing the aforementioned cable assembly, upon turning the winch in the appropriate direction the cover assembly will be translated vertically upwardly, while upon rotating the winch in the opposite direction, the cover assembly will move transversely downwardly under the action of gravity. It is to be understood that the connection of the cables to one another or to the winch and the number of cables may be varied as long as they are connected to the cover assembly frame and function to translate the cover assembly such as above described.

To prevent water collecting on the cover adjacent the frame members 33–35, and to facilitate replacing the cover assembly, advantageously conventional cooperating snap fastener or twistlock mechanism is provided on the frame members 33–35 and the cover with one part 79 of each snap fastener being mounted on the underside of the respective frame member and one part 78 on the peripheral edge portion of the cover. By mounting the snap fasteners in spaced relationship there will be a slight gap between vertically adjacent parts of the outer peripheral edge of the cover and the respective frame member and horizontally between adjacent fasteners which will permit water to flow therebetween.

By providing the snap fasteners and the hooks, the cover can be easily removed from the cover frame for storage or replacement.

With the cover assembly in an elevated position and the lift assembly in its lowered position, the boat may be floated to a position to be elevated by the lift assembly and upon being elevated will be beneath the cover assembly such that the forwardmost part of the boat will be at least a slight distance rearwardly of the juncture of frame members 33, 34 and the transverse rear part of the boat will be at least a slight distance forwardly of frame member 35. Further, the sides of the boat will be located below and transversely intermediate the transverse adjacent parts of the frame members 33, 34. Upon lowering the cover assembly, the frame members 33–35 and the outer peripheral edge portion of the cover are moved to a lower elevation than the upper, outer peripheral edge portions of the boat whereby the cover engages the upper, outer peripheral edge portions 13*b* around substantially the entire periphery thereof to form a relatively close fit therewith. That is the cover is draped over the top of the boat such that from the outer peripheral edge of the cover, the cover extends upwardly to engage the upper, outer peripheral edge of the boat and then upwardly and inwardly to the respective hook member 57. Due to the provision of the spring members the cover can be readily easily draped over the top of the boat even though the boat is not in a completely centered relationship to the frame members 33–35. Additionally, due to the provision of the springs, the amount of drag of the cover over the boat as the frame members 33–35 are moved below the elevation of the boat peripheral edge portion 13*b* is minimized, as is the likelihood of there being gaps between the cover and the boat peripheral edge portion 13*b*. By using the cover assembly of this invention one can stand on the dock and lower the cover to form a close fit with the boat outer peripheral edge portion to block the access of dirt, insects and etc. into the interior of the boat.

For elevating the cover assembly, one can stand on the dock and operate the winch 58 in the appropriate direction, and when the cover assembly is elevated to a sufficient height one can move off the dock and into the boat.

What is claimed is:

1. For covering the top portion of a boat in an elevated position on a lift assembly that is mounted on a main frame, cover apparatus comprising a cover subframe adapted to enclose an opening of a size and shape to permit the subframe to surround the boat and be moved vertically above the boat, a collapsible cover of a substantially larger area than the subframe opening and having an outer peripheral edge portion secured to the subframe around the periphery thereof, frame means secured to the subframe to extend thereabove and across the subframe opening, a plurality of spaced resilient means dependingly secured to the frame means and respectively secured to the cover in substantial horizontal spaced relationship to one another and a substantial distance from the subframe for retaining the parts of the cover to which they are secured at a higher elevation than the subframe, and means for mounting the subframe on the main frame and adapted for vertically moving the subframe between a lowered position that the cover is adapted to engage the boat in the boat elevated position, and an elevated position a substantial distance vertically above the boat.

2. The apparatus of claim 1 further characterized in that said subframe comprises a pair of longitudinally elongated side frame members that have rear portions substantially transversely spaced from one another, that the frame means comprises a longitudinally elongated top frame member and means for mounting said top frame member on the subframe at a substantially higher elevation than the subframe and transversely between said rear portions, and that at least one of said resilient means is dependingly mounted on the top frame member.

3. The apparatus of claim 2 further characterized in that the means for mounting the subframe includes a cable assembly mounted on the main frame and having cable runs secured to the side frame members, and means for moving the cable runs to vertically translate the cover assembly.

4. The apparatus of claim 2 further characterized in that the frame means includes a transverse frame member attached to the top frame member to extend on either transverse side thereof at a substantially higher elevation than said side frame members and that the plurality of resilient means includes a resilient means dependingly secured to the transverse frame member on either side of the top frame member and to the cover a substantial distance transversely inwardly of the transversely adjacent portion of the side frame member.

5. The apparatus of claim 4 further characterized in that each of said resilient means comprises a coil spring.

6. For covering the top portion of a boat having an upper, outer peripheral edge portion that extends generally horizontally around the boat while the boat is supported above the level of the water by boat lift mechanism on a main frame, cover apparatus comprising a collapsible cover of perimetric dimensions substantially greater than the maximum perimetric dimensions of the boat in plan view, a subframe for at least nearly surrounding the boat at an elevation between the boat bottom and the upper, outer peripheral edge portion and vertically movable above the boat out of engagement therewith, means for securing the cover peripheral edge portion to the subframe, means for mounting the subframe on the main frame for vertical movement between an elevation vertically between the level of the water and the boat upper, outer peripheral edge portions, and means mounted on the subframe for resiliently supporting the cover to have the cover abuttingly engage substantially the entire boat upper, outer peripheral edge portion.

7. For covering the top portion of a boat having an upper, outer peripheral edge portion, a main frame, a cover assembly that includes a cover subframe enclosing an opening that in a generally horizontal plane is of a size and shape larger than the boat upper, outer peripheral edge portion, a collapsible cover of a substantially larger area than the subframe and having a peripheral edge portion, means for securing the cover peripheral edge portion to the subframe around the periphery thereof, and means mounted on the subframe for resiliently retaining spaced portions of the cover that are a substantial distance inwardly of the subframe at higher elevations than the subframe, and means mounted on the main frame and connected to the cover assembly for raising the entire cover assembly and alternately lowering the cover assembly, the means mounted on the subframe for resiliently retaining spaced portions of the cover at higher elevations than the subframe including a longitudinally elongated frame member, means for mounting the frame member on the subframe at a substantially higher elevation than the subframe, and a plurality of means dependingly mounted on the frame member for resiliently attaching vertically adjacent parts of the cover to the frame member.

8. The apparatus of claim 7 further characterized in that each of the last mentioned means are attached to the cover at locations that are transversely and longitudinally spaced from one another by dimensions that are substantially less than the corresponding dimensions of the boat.

9. The apparatus of claim 7 further characterized in that the peripheral edge portion securing means comprises a plurality of spaced cooperating means, in part mounted in spaced relationship on the cover peripheral edge portion and in part mounted in spaced relationship on the vertically lower part of the subframe, for removably securing the cover to the subframe.

* * * * *